US011027567B2

(12) United States Patent
Sugiyama

(10) Patent No.: US 11,027,567 B2
(45) Date of Patent: Jun. 8, 2021

(54) SHEET PROCESSING APPARATUS AND IMAGE FORMING SYSTEM COMPRISING THE SAME

(71) Applicant: Akira Sugiyama, Yamanashi-ken (JP)

(72) Inventor: Akira Sugiyama, Yamanashi-ken (JP)

(73) Assignee: CANON FINETECH NISCA INC., Misato (JP)

( * ) Notice: Subject to any disclaimer, the term of this patent is extended or adjusted under 35 U.S.C. 154(b) by 38 days.

(21) Appl. No.: 16/376,566

(22) Filed: Apr. 5, 2019

(65) Prior Publication Data

US 2019/0308437 A1 Oct. 10, 2019

(30) Foreign Application Priority Data

Apr. 10, 2018 (JP) ..... JP2018-075555

(51) Int. Cl.

| | |
|---|---|
| ***B31F 5/02*** | (2006.01) |
| ***B42C 1/12*** | (2006.01) |
| ***G03G 15/00*** | (2006.01) |
| ***B65H 37/04*** | (2006.01) |

(52) U.S. Cl.

CPC ..... *B42C 1/12* (2013.01); *B31F 5/02* (2013.01); *B65H 37/04* (2013.01); *G03G 15/6544* (2013.01)

(58) Field of Classification Search

CPC ..... B65H 37/04; B65H 2301/51616; B65H 2301/43828; B31F 1/04; B31F 5/02; G03G 15/6544; G03G 2215/00827; G03G 2215/00852

USPC ..... 270/45, 58.07, 58.08

See application file for complete search history.

(56) References Cited

U.S. PATENT DOCUMENTS

| | | | | |
|---|---|---|---|---|
| 8,028,984 | B2 * | 10/2011 | Taki | B42B 4/00 270/58.07 |
| 8,146,908 | B2 * | 4/2012 | Terao | B27F 7/006 227/2 |
| 8,226,079 | B2 * | 7/2012 | Ozawa | B65H 29/34 270/58.08 |
| 9,409,740 | B2 * | 8/2016 | Kubo | B31F 5/02 |
| 9,586,429 | B2 * | 3/2017 | Nakagomi | B65H 43/02 |
| 9,725,275 | B2 * | 8/2017 | Matsuki | B65H 37/04 |
| 9,776,449 | B2 * | 10/2017 | Shimura | G03G 15/6544 |
| 9,969,144 | B1 * | 5/2018 | Awano | B42B 4/00 |

FOREIGN PATENT DOCUMENTS

| | | | |
|---|---|---|---|
| JP | 2005-096392 | A | 4/2005 |
| JP | 2011-184154 | A | 9/2011 |
| JP | 2015-009966 | A | 1/2015 |
| JP | 2015-016970 | A | 1/2015 |
| JP | 2015-209335 | A | 11/2015 |

* cited by examiner

*Primary Examiner* — Leslie A Nicholson, III
(74) *Attorney, Agent, or Firm* — Manabu Kanesaka

(57) ABSTRACT

Disclosed herein is a sheet-binding apparatus. The apparatus has two sheet binding units, each configured to bind the sheets manually inserted from outside. The sheet binding units operate independently, each at the timing appropriate for a specific need.

14 Claims, 7 Drawing Sheets

11 · · · Binding section
12 · · · Accumulating tray
18 · · · Stapler
21 · · · First manual binding section
22 · · · Second manual binding section
28 · · · Non-staple mechanism

SHEET PROCESSING APPARATUS AND IMAGE FORMING SYSTEM COMPRISING THE SAME

BACKGROUND OF THE INVENTION

1. Field of the Invention

This invention relates to a sheet processing apparatus for performing a post-processing on sheets each having an image formed on it, and relates to an image forming system comprising the sheet processing apparatus.

2. Description of the Related Arts

Hitherto used is a sheet processing apparatus that is configured to bind sheets each having an image formed by an image forming apparatus such as a printer or a copier. Generally, sheet processing apparatuses of this type are configured to lay a plurality of sheets ejected from an image forming apparatus, one upon another, on the processing tray provided downstream the sheet ejecting passage, to staple-bind the sheets at one part or some parts, and to store the sheets in the accumulating tray arranged still downstream the sheet ejecting passage.

With regard to the binding process mentioned above, a sheet processing apparatus is available, in which not only the binding process using staples, but also a non-stable binding process using no staples can be selected. Such a sheet processing apparatus is configured to select the staple binding or non-staple binding, in order to bind the sheets transported from the sheet ejecting passage onto the processing tray and aligned with one another on the processing tray.

The sheet processing apparatus described above can perform various binding operations on the sheets accumulated on the processing tray, such as one-part binding of binding sheets at the left corner or right corner and two-part binding of binding sheets at one long side or one short side of each sheet. In the non-stable binding process, the sheets are bound at one part, either the left corner or the right corner, because the number of sheets that can be bound together is limited. That is, only a few sheets can be bound together.

In the non-stable binding process, no staples are used. The number of sheets that can be bound together is therefore limited as described above. Further, the non-stable binding process is performed less frequently than the staple binding process. In order to perform the non-stable binding process automatically as the stable binding mechanism is performed, the apparatus must be massive and disadvantageous in terms of cost and performance.

Further, in the conventional sheet processing apparatus, either the staple binding process or the non-staple binding process is selected for the sheets accumulated on the tray for the post-processing. Therefore, the non-needle binding may be performed in some cases even if the number of sheets exceeds the prescribed value. If the non-staple binding is performed on more sheets than the prescribed number, it will result in an undesirable sheet binding.

SUMMARY OF THE INVENTION

This invention relates to a sheet-binding apparatus for binding sheets together. The apparatus comprises: a first insertion section having a slit through which sheets may be manually inserted from outside; a staple-binding mechanism for staple-binding the sheets inserted into the first insertion section; a second insertion section having a slit through which sheets may be manually inserted from outside; and a non-staple binding mechanism for binding the sheets inserted into the second insertion section, without using staples.

DETAILED DESCRIPTION OF THE PREFERRED EMBODIMENT

Figure 1:
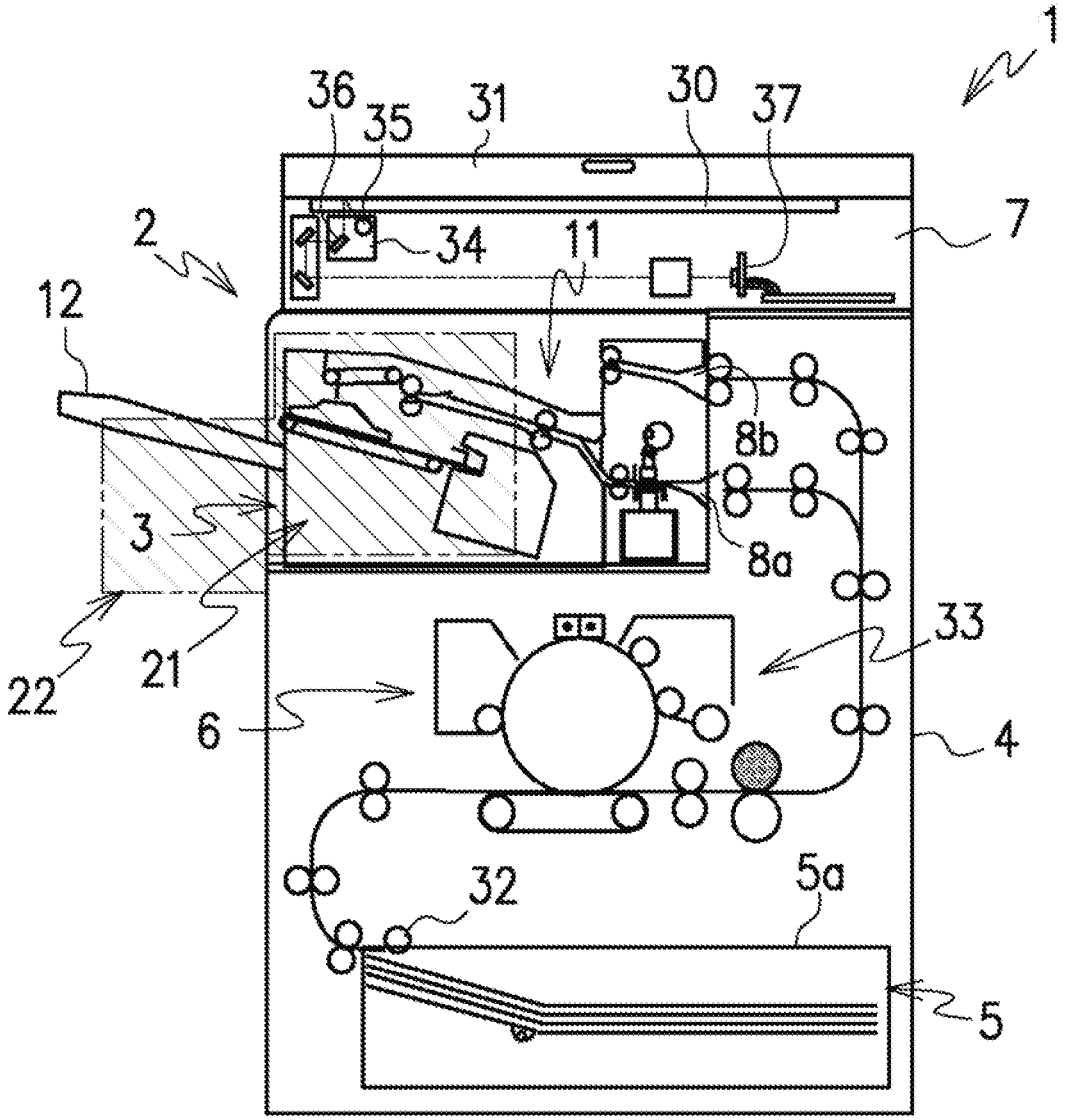
FIG. 1 is a schematic diagram of an image forming system which comprises a sheet processing apparatus according to the present invention.

The embodiments of this invention will be described below in detail, with reference to the accompanying drawings. FIG. 1 is a sectional view of an image forming system 1, as viewed at the operating front side, which incorporates a sheet processing apparatus 2 which is a post-processing unit. The image forming system 1 comprises a housing 4, a sheet supplying section 5, an image forming section 6, and an original reading section 7, and the like. The sheet supplying section 5, image forming section 6 and the original reading section 7 are incorporated in the housing 4. The sheet processing apparatus 2 is arranged in a space 3, into which sheets each having an image formed in the image forming section 6 are ejected.

The image forming system 1 comprises various mechanisms for forming images. The original reading section 7 reads the original laid on the platen 30, and the image forming section 6 prints the image on the sheets sequentially transported from the sheet supplying section 5. The sheets, each having an image printed on it, are transported into the space 3. The sheets are then bound together in one of various ways in the sheet processing apparatus 2 arranged in the space 3.

The sheet supplying section 5 comprises at least one cassette 5*a* for holding sheets. A plurality of sheets is held in the cassette 5*a*. The sheet supplying section 5 may have, by option, two or more cassettes. Therefore, sheets of one size can be held in one cassette, and sheets of another size can be held in another cassette. The cassette 5*a* incorporates sheet feeding rollers 32 for feeding sheets and a sheet separating unit (not shown) for separating one sheet from another.

The image forming section 6 comprises an image forming mechanism 33 of, for example, electrostatic type. The image forming mechanism 33 has a plurality of drums for the color components, respectively, each composed of photosensitive material (photoconductor). For each drum, there are arranged a light-emitting device (e.g., laser head), a developing device, and the like. On each drum, a latent image (electrostatic image) is formed by the light-emitting device. In the developing device, toner ink is applied to each drum, forming an ink image. The ink images are transferred from the drums onto transfer belts and are synthesized on the sheet.

The original reading section 7 comprises a platen 30 and a reading carriage 34 which moves back and forth along the platen 30. The platen 30 is made of transparent glass. The reading carriage 34 has a light-source lamp 35, a reflection mirror 36 for guiding the light reflected from the original, and a photoelectric transducer element 37. The photoelectric transducer element 37 is constituted by a line sensor which is arranged in the widthwise direction (i.e., main scanning direction) of the original mounted on the platen 30. As the reading carriage 34 moves back and forth in the sub-scanning direction, namely the direction at right angles to the widthwise direction (i.e., main scanning direction) of the platen 30, the photoelectric transducer element 37 reads the image formed on the original. Above the platen 30, an original pushing plate 31 is arranged, covering the original.

The image forming section 6 transfers the image read by the original reading section 7, to the sheet transported from the sheet supplying section 5. The sheet to which the image has been transferred is ejected into a first transport path 8*a* or into a second transport path 8*b* which is provided in the sheet processing apparatus 2 shown in FIG. 2. The first transport path 8*a* is selected so that the sheets may be subjected to various binding processes by the sheet processing apparatus. The second transport path 8*b* is selected so that the sheets may be ejected onto an ejected-sheet tray 20. The image-formed sheets transported along the first transport path 8*a* are transported into the sheet processing apparatus 2, are aligned with one another, and are subjected to a specific process. The sheets processed are accumulated on an accumulating tray 12 arranged downstream.

Figure 2:
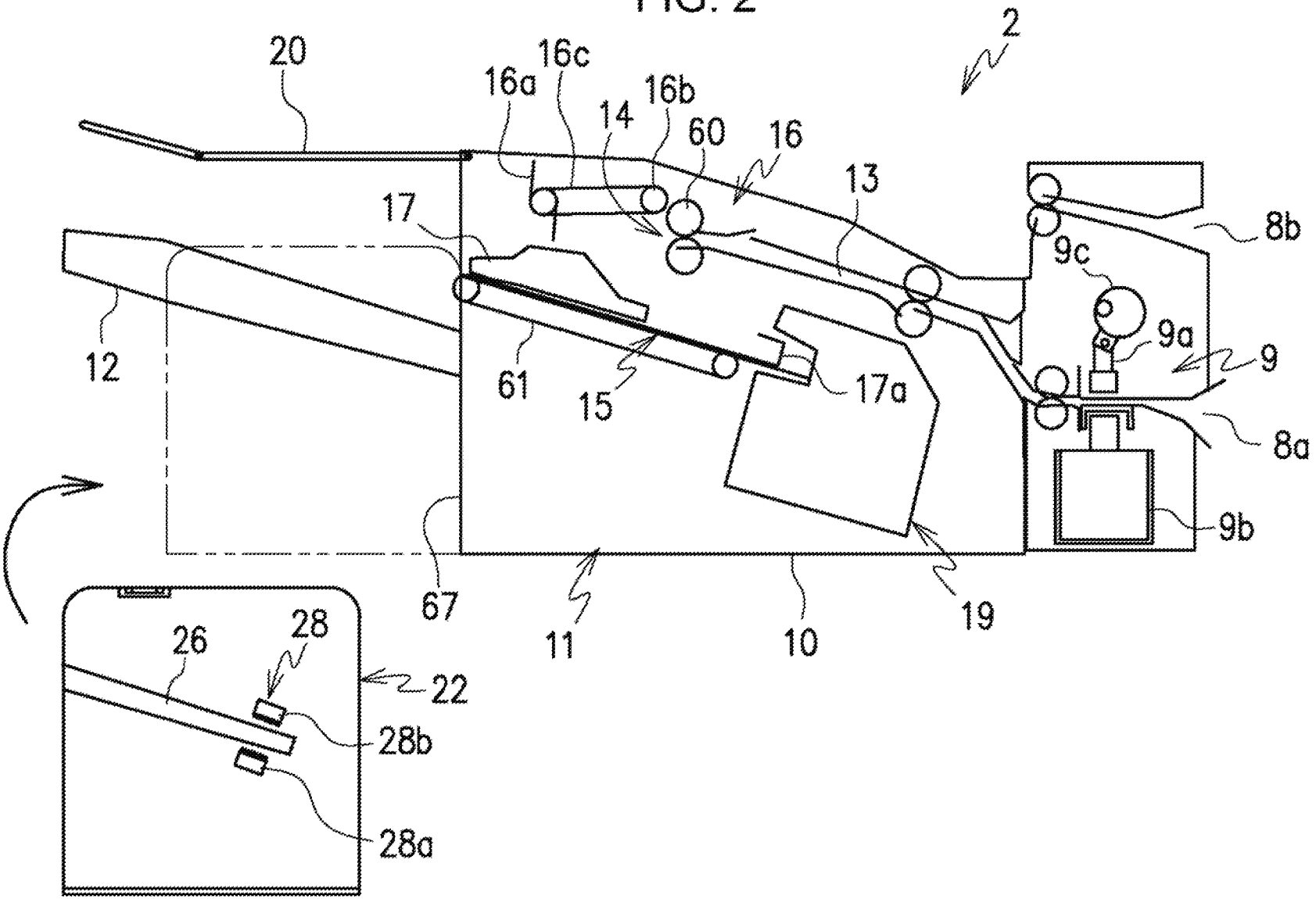
FIG. 2 is a sectional view of the main section of the sheet processing apparatus.

As shown in FIG. 2, the sheet processing apparatus 2 comprises a housing 10 small enough to be incorporated in the space 3 provided in the image forming system 1. The sheet processing apparatus 2 further comprises a punching process section 9 arranged upstream the housing 10, a binding section 11 arranged downstream the punching process section 9, and an accumulating tray 12 located downstream the binding section 11. The punching process section 9 comprises the above-mentioned first transport path 8*a*, a punching mechanism 9*a* configured to punch any sheet transported along the first transport path 8*a*, a trash bin 9*b* for storing the chips made as the punching mechanism 9*a* punches each sheet, and a second transport path 8*b* for guiding sheets onto the ejected-sheet tray 20 provided on the upper surface of the binding section 11. The punching mechanism 9*a* comprises a drive motor (not shown) and a drive cam 9*c* coupled to the drive motor. The drive cum 9*c* shown in FIG. 2 is an eccentric cam.

The binding section 11 comprises a transporting unit (third transport passage) 13, a passage exit port 14, an ejecting unit (pair of ejecting rollers) 60, a processing tray 15, a paddle rotary member 16*a*, an aligning plate 17*a*, a pair of side-aligning plates 17*b* and 17*c*, a stapler 18, and a sheet ejecting belt 61. The transporting unit 13 transports any sheet coming from the punching process section 9. The passage exit port 14 is provided downstream the transporting unit 13. The ejecting unit 60 ejects any sheet from the passage exit port 14. The processing tray 15 is arranged downstream the passage exit port 14 and configured to hold the sheets ejected by the ejecting rollers 60. The paddle rotary member 16*a* takes sheets from the processing tray 15 and moves them in a take-up direction different from the sheet transporting direction. The aligning plate 17*a* aligns the sheets, at the leading end, in the sheet-taking direction (at the trailing end, in the sheet transporting direction). The side-aligning plates 17*b* and 17*c* align the sheets on the processing tray 15, at both sides in the widthwise direction at right angles to the sheet transporting direction. The stapler 18 binds together the sheets aligned on the processing tray 15. The sheet ejecting belt 61 ejects the sheets bound together by the stapler 18, onto the accumulating tray 12.

The paddle rotary member 16*a* has a band-shaped elastic member, and is secured to the distal end of a lifting/lowering arm 16*c*. The lifting/lowering arm 16*c* has a support axle 16*b* at the base part. The lifting/lowering arm 16*c* rotates around the support axle 16*b* functioning as fulcrum, and moves the paddle rotary member 16*a* up and down between the sheet take-in position where it contacts the sheet placed on the processing tray 15 and the sheet releasing position where it releases the sheet placed on the processing tray 15.

The binding section 11 has a binding mechanism 19. The binding mechanism 19 has the function of staple-binding the sheets aligned by the aligning plate 17*a* and pair of side-aligning plates 17*b* and 17*c*, by using the stapler 18. That is, the stapler 18 automatically performs staple-binding on the sheets which are aligned on the processing tray 15. In the staple binding, one stapler 18 can move to the corner of each sheet aligned with any other, and bind the sheets at one part, and can move to along the long side of the sheets and bind the sheets at two parts.

As shown in FIG. 1, the sheet processing apparatus 2 according to this invention comprises, in addition to the binding section 11, a first binding unit (first manual binding section) 21 and a second binding unit (second manual binding section) 22, which binds the sheets set from outside by, for example, manual feeding. The first manual binding section 21 is arranged adjacent to the binding section 11 located in the space 3 that is provided in the image forming system 1. As shown in FIG. 1 and FIG. 2, the second manual binding section 22 is arranged adjacent to the accumulating tray 12 that protrudes outside from the space 3. In this embodiment, the accumulating tray 12 of the sheet processing apparatus 2 is configured to protrude outside from the space 3 provided in the image forming system 1. Therefore, the second manual binding section 22 is also positioned outside the space 3. However, at least one part of the second manual binding section 22 can also be configured to be located in the space 3 in the image forming system 1 in which at least one part of the accumulating tray 12 is provided in the space 3.

Figure 3:
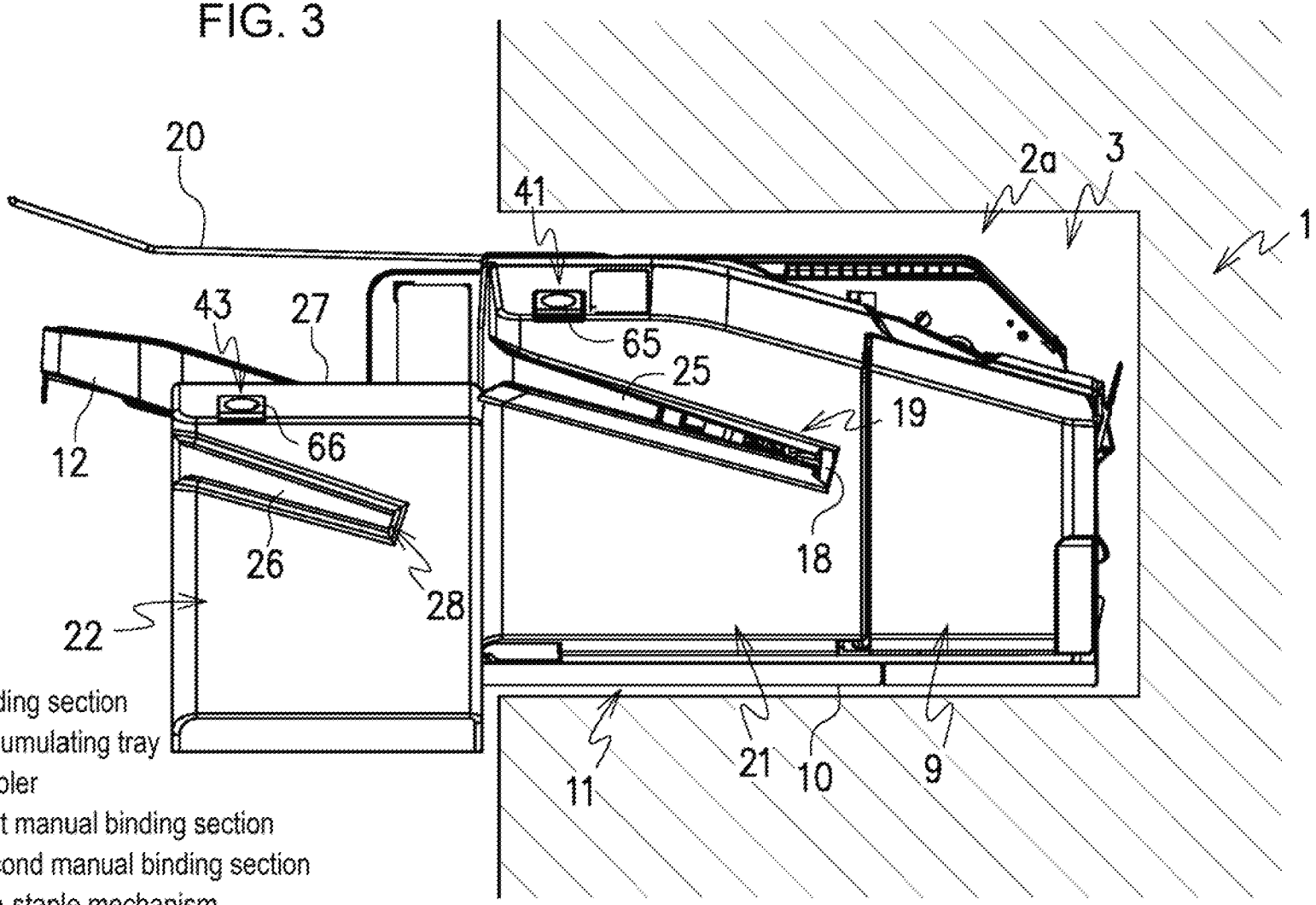
FIG. 3 is a sectional view of a sheet processing apparatus according to a first embodiment, which comprises first and second manual binding sections provided at the front side.
Figure 4:
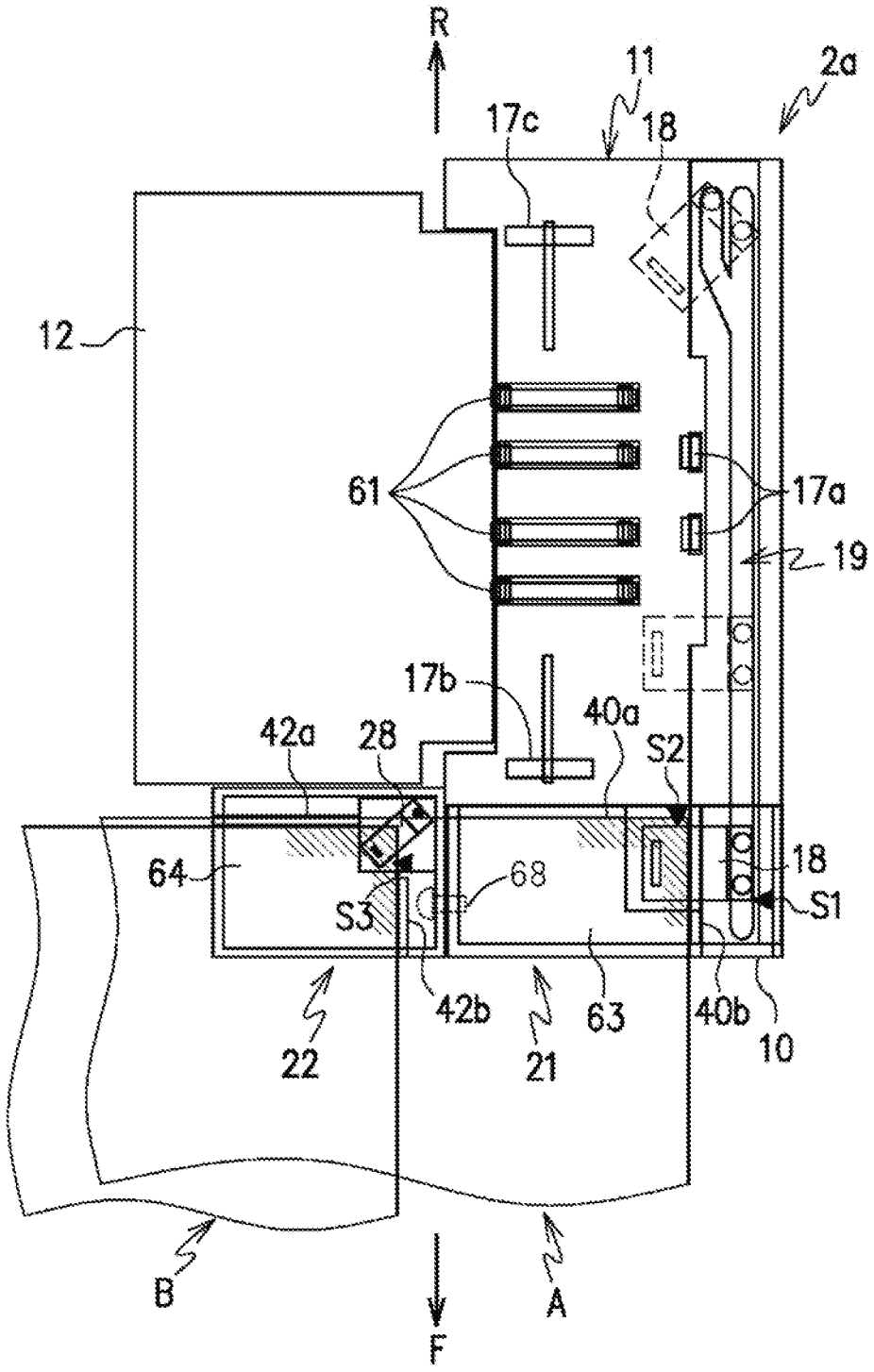
FIG. 4 is a plan view of the sheet processing apparatus according to the first embodiment.

FIG. 3 and FIG. 4 illustrate the configuration of a sheet processing apparatus 2*a* according to the first embodiment. In this embodiment, the first manual binding section 21 is arranged adjacent to one end of the front (F) of the binding section 11, as viewed in the sheet-widthwise direction of the binding section 11. With respect to the accumulating tray 12, the second manual binding section 22 is arranged adjacent to one end of the front (F) of the accumulating tray 12, as is viewed in the sheet-widthwise direction of the accumulating tray 12.

The binding section 11 and the first manual binding section 21 are formed integral with each other, constituting a staple-binding unit. As shown in FIG. 4, the first manual binding section 21 is formed by extending a part of the front (F) of the binding section 11 which intersects, at right angles, with the direction of transporting sheets in the binding section 11. The first manual binding section 21 has a first insertion port 25 shaped like a slit and comprises a first support member 63, first and second control plates 40*a* and 40*b*, a first sheet-detecting sensor S2, a stapler-detecting sensor S1, and an operation button 41. Through the first insertion port 25, a sheet can be manually inserted into the first manual binding section 21. The first support member 63 supports the sheet A inserted through the first insertion port 25. The first and second control plates 40*a* and 40*b* hold the two edges of each sheet A inserted, defining a corner of each sheet A at such a position as to bind the sheets A together. The first sheet-detecting sensor S2 detects that the sheets A are positioned and can be bound together at the corner. The stapler-detecting sensor S1 detects whether the stapler 18 has moved to the manual-stapling position of the first manual binding section 21. The operation button 41 may be pushed to make the stapler 18 bind the sheets together. The operation button 41 has an LED lamp 65 that emits light if the first sheet-detecting sensor S2 detects a sheet A.

The stapler 18 has its home position at the manual stapling position in the first manual binding section 21. That is, the stapler 18 usually stays at the manual stapling position, i.e., home position. The stapler 18 moves in the widthwise direction of the sheet, stops at the sheet binding position, and binds the sheets together on the processing tray 15.

The first manual binding section 21 operates in a specific sequence. The first manual binding section 21 starts operating when sheets A aligned at one end are inserted through the first insertion port 25. When each sheet A has its corner abut on the first and second control plates 40*a* and 40*b*, the first sheet-detecting sensor S2 detects one end of each sheet A, and the LED lamp 65 is turned on. The user can therefore recognize that the sheets A are at the position where they can be bound together. The user then pushes the operation button 41. The stapler 18 therefore starts binding the sheets A. The first insertion port 25 has such a width that more than 30 sheets of ordinary type cannot be inserted at a time, because the stapler 18 cannot bind more than 30 sheets.

As shown in FIG. 4, the second manual binding section 22 comprises a non-staple mechanism 28, a second insertion port 26 shaped like a slit, a second support member 64, first and second control plates 42*a* and 42*b* and a second sheet-detecting sensor S3. The non-staple mechanism 28 is configured to perform non-staple binding. Through the second insertion port 26, sheets may be inserted. The second support member 64 supports the sheets inserted through the second insertion port 26. The first and second control plates 42*a* and 42*b* respectively hold the two edges of each sheet B inserted, which define a corner. The second sheet-detecting sensor S3 detects whether the sheets B have abut on the first and second control plates 42*a* and 42*b* and thereby positioned to be bound.

As shown in FIG. 2, the non-staple mechanism 28 comprises a pair of teeth members (i.e., upper teeth member 28*a* and lower teeth member 28*b*). These teeth members bite sheets, deforming each sheet under pressure, crushing sheet fibers and entangling them, thereby binding the sheets together. Thus, the non-staple mechanism 28 performs so-called pressure-bond binding. Besides the pressure-bond binding, various binding methods, such as half-blank binding and lance binding, are available. Still another binding method is available, in which the sheets are bent and then passed through a hole. In this embodiment, the non-staple mechanism 28 is arranged at a rear (R) corner of the second support member 64. The lower teeth member 28*a* is secured, with its upper surface flush with the mounting surface of the second support member 64. The upper teeth member 28*b* is configured to be moved by a drive unit (not shown) to the position where it meshes with the lower teeth member 28*a* and to a position where it is away from the lower teeth member 28*a*.

As shown in FIG. 3, the second manual binding section 22 is arranged in front (F) of the accumulating tray 12, side-by-side with the first manual binding section 21 as viewed from the front. Further, the upper surface of the second manual binding section 22 functions as a support surface 27 that supports a part of the sheet A inserted into the first insertion port 25 of the first manual binding section 21. The second insertion port 26 is positioned below the support surface 27, and is inclined by an angle substantially equal to the angle by which the first insertion port 25 is inclined. The non-staple mechanism 28 has been secured at a position where it obliquely presses the sheets B inserted through the second insertion port 26. The number of sheets B that can be processed in the non-staple mechanism 28 is limited to about five (5). Therefore, the second insertion port 26 has a width smaller than the width of the first insertion port 25, so that less sheets may be inserted through it than through the first insertion port 25.

The second manual binding section 22 has an operation button 41 and an LED lamp 66. The operation button 41 may be pushed to make the non-staple mechanism 28 bind sheets. The LED lamp 66 is turned on when the first sheet-detecting sensor S2 detects a sheet. The second manual binding unit 22 starts a sequence of operations when the sheets B aligned at one end are inserted into the second insertion port 26. When the sheets B so inserted abut, at a corner, on the first and second control plates 42*a* and 42*b*, the second sheet-detecting sensor S3 detects one end of each sheet B, and the LED lamp 66 is turned on. Seeing the LED lamp 66 turned on, the user recognizes that the sheets B are at the position where they can be bound together. Then, the user may push the second operation button 43. When the second operation button 43 is pushed, the non-staple mechanism 28 is driven, binding the sheets B together.

The second manual binding section 22 used in this embodiment is a non-staple binding unit formed integral and comprising, as shown in FIG. 2, a non-staple mechanism 28, a drive unit for driving the non-staple mechanism 28, a second insertion port 26, a second support member 64, first and second control plates 42*a* and 42*b*, and a second sheet-detecting sensor S3. This non-staple binding unit is secured, by fastening members 68 such as screws, to a side surface 67 at the front of the stapling unit that comprises the binding section 11 and the first manual binding section. Hence, the non-staple binding unit is coupled to the stapling unit with the fastening members 68, and can be decoupled from the stapling unit by removing the fastening members 68.

In the sheet processing apparatus 2*a* according to this embodiment, the second manual binding section 22 is arranged in front (F) of the accumulating tray 12 and at the side of the first manual binding section 21 in left-to-right direction. Therefore, the front surfaces of the first manual binding section 21 and second manual binding section 22 can be substantially flush with each other, preventing the apparatus from becoming large. Further, since the first insertion port 25 is located higher than the second insertion port 26 and the upper surface 27 of the second manual binding section 22 is arranged, supporting the sheet inserted through the first insertion port 25 of the first manual binding section 21, the sheets can be stabilized as they are bound by the first manual binding section 21. Moreover, the binding failure can be reduced, because the first and second manual binding sections 21 and 22 have the first and second insertion ports 25 and 26, respectively, and because the first and second insertion ports 25 and 26 have a width for passing sheets in number appropriate for the binding method.

Figure 5:
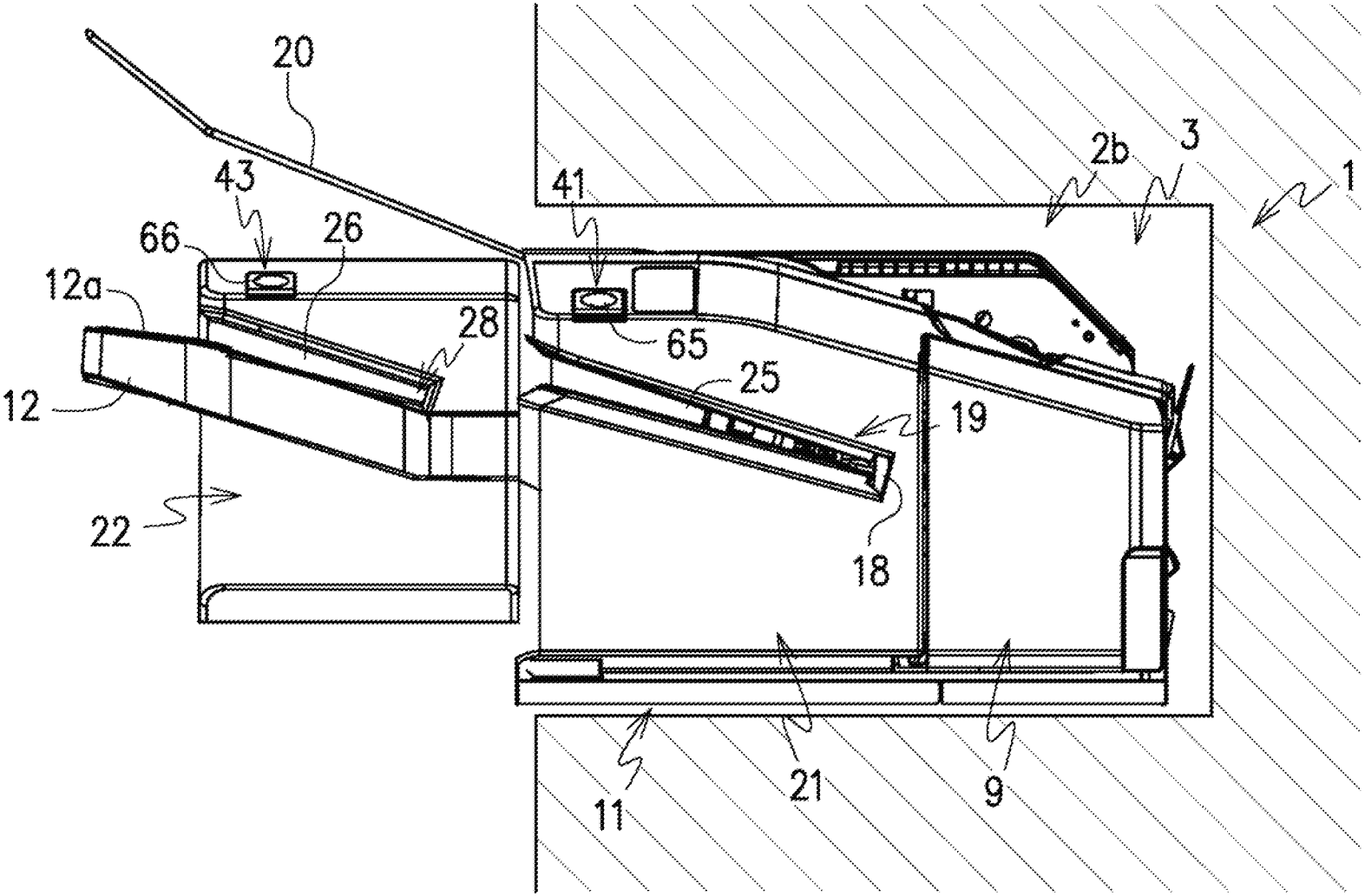
FIG. 5 is a sectional view of a sheet processing apparatus according to a second embodiment, which comprises a first manual binding process section at the front side and a second manual binding section at the rear side.
Figure 6:
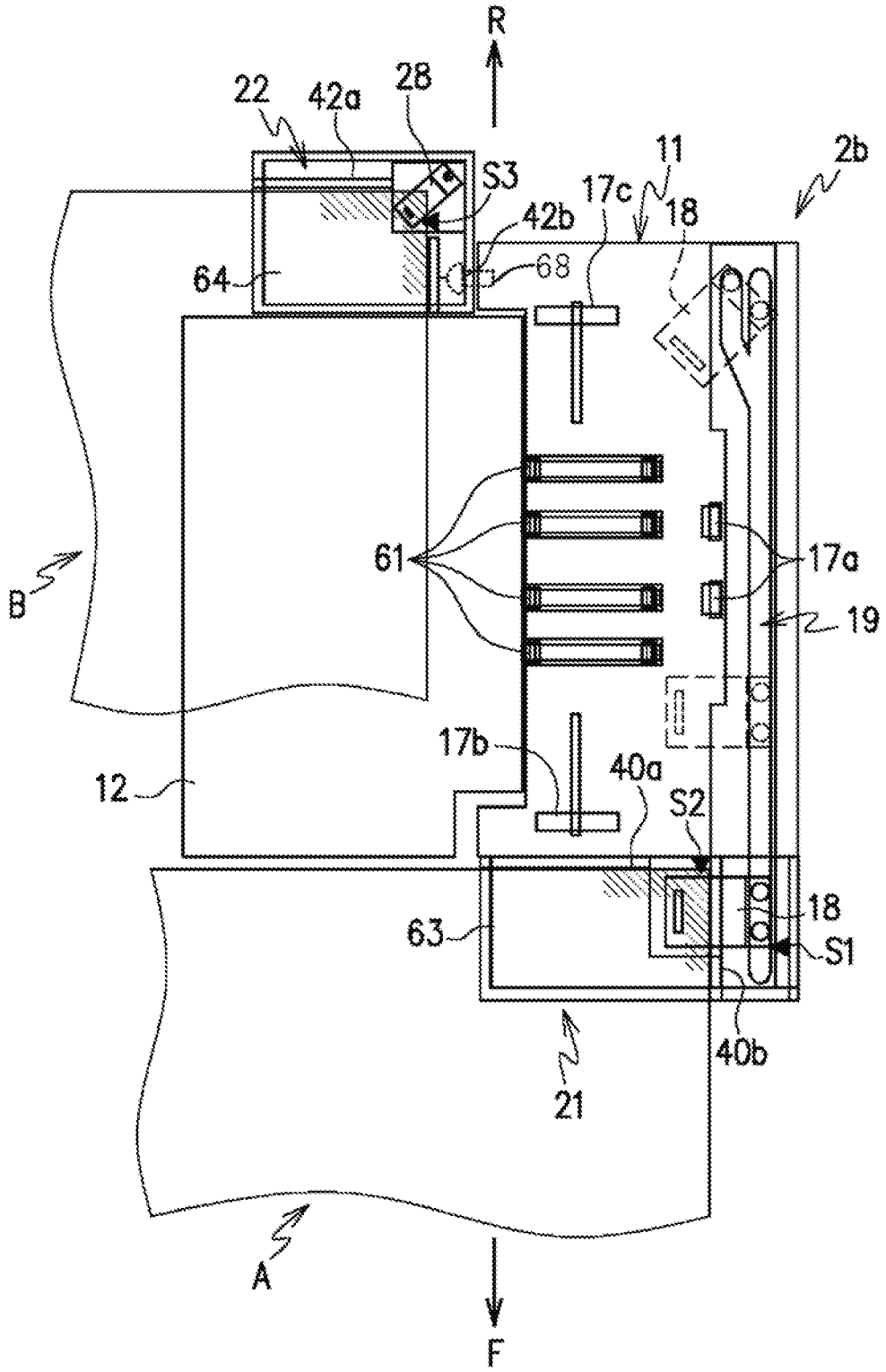
FIG. 6 is a plan view of the sheet processing apparatus according to the second embodiment.

FIG. 5 and FIG. 6 show the configuration of a sheet processing apparatus 2*b* according to the second embodiment. In this embodiment, the second manual binding section 22 is arranged on the rear (R) side in the widthwise direction of the sheet, namely on the side facing away from the accumulating tray 12. In this embodiment, the upper surface of the accumulating tray 12 can be used as support surface 12*a* to support a part of the sheet B inserted into the second insertion port 26 of the second manual binding section 22. Therefore, as shown in FIG. 5, the second manual binding section 22 can be located higher than otherwise, and the height and inclination of the second insertion port 26 can be matched with the upper surface of the accumulating tray 12. As a result, the accumulating tray 12 supports the sheet B, except that part existing in the second insertion port 26, and the sheet B can be stabilized and well-bound to another sheet. The second embodiment is different from the first embodiment, only in that the second manual binding section 22 is arranged differently. The first and second manual binding sections 21 and 22 are similar in structure and function to those of the sheet processing apparatus 2*b*, and will not be described here.

Figure 7:
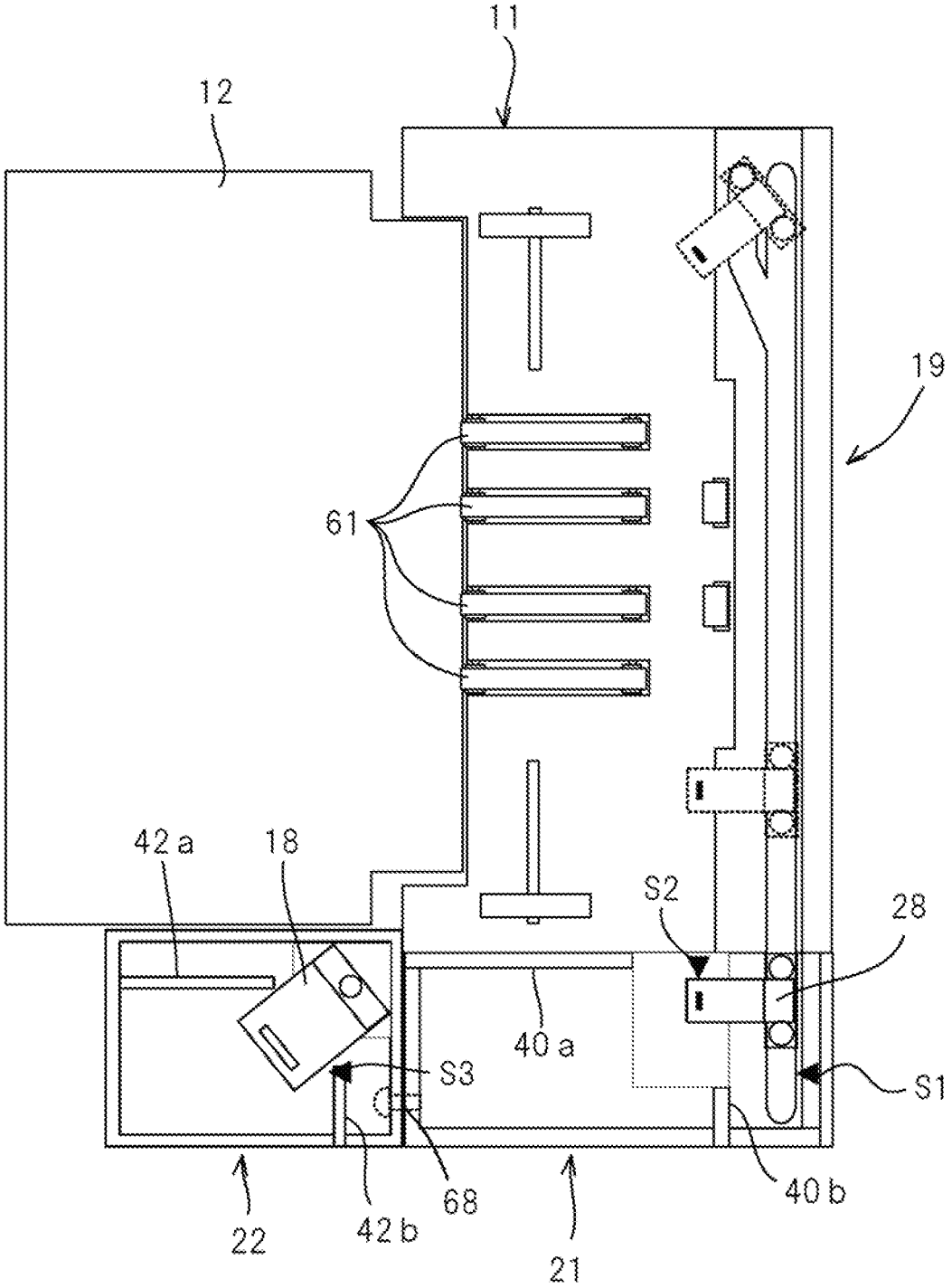
FIG. 7 is a plan view of a sheet processing apparatus according to a third embodiment.

In the embodiments described above, the stapler 18 is provided in the first manual binding section 21, and the non-staple mechanism 28 is provided in the second manual binding section 22. In a third embodiment, the non-staple mechanism 28 may be provided in the first manual binding section 21, and the stapler 18 may be provided in the second manual binding section 22. In the third embodiment, the non-staple mechanism 28 is configured to move between the binding section 11 and the second manual binding section 22 as is illustrated in FIG. 7. The non-staple mechanism 28 moves in the widthwise direction of the sheets on the processing tray 15, along the long side of each sheet, and binds the sheets together at one part or two parts.

In the sheet processing apparatuses 2*a* and 2*b* according to the first and second embodiments, respectively, the first manual binding section 21 and the second manual binding section 22 can be arranged in the space at one side of the binding section 11 and one side of the accumulating tray 12, each protruding a little therefrom. The sheet processing apparatuses can therefore be made compact, and can be easily incorporated into a small image forming system having a small space 3. Further, the second manual binding section 22 may be arranged in front of the first manual binding section 21 or the punching process section 9, though the section 22 is arranged adjacent to the front or rear of the accumulating tray 12 in the first and second embodiments. Still further, sheets can be easily hand-fed, because the first manual binding section 21 and the second manual binding section 22 are arranged in an open space provided at the operation side (i.e., front) of the image forming system 1. Furthermore, the second manual binding section 22 is a mechanism independent of the binding mechanism 19 provided in the binding section 11, and can therefore be arranged in front of the accumulating section 12 or at the rear thereof, and can be used, if necessary, as an optional component.

This application is based upon and claims the benefit of priority from the prior Japanese Patent Application No. 2018-075555, filed Apr. 10, 2018, the entire contents of which are incorporated herein by reference.

What is claimed is:

1. A sheet-binding apparatus for binding sheets together, comprising:

a first insertion section having a slit through which parts of sheets are manually inserted from outside;

a staple-binding mechanism for staple-binding the sheets inserted into the first insertion section;

a second insertion section having a slit through which parts of sheets are manually inserted from outside; and a non-staple binding mechanism for binding the sheets inserted into the second insertion section, without using staples, wherein the first insertion section is arranged above the second insertion section.

2. The sheet-binding apparatus according to claim 1, further comprising:

a first operation section for operating the staple-binding mechanism; and a second operation section for operating the non-staple binding mechanism.

3. The sheet-binding apparatus according to claim 1, wherein a gap of the first insertion section is larger than a gap of the second insertion section.

4. The sheet-binding apparatus according to claim 1, further comprising:

a staple-binding unit composed of the first insertion section and the staple-binding mechanism;

a non-staple binding unit composed of the second insertion section and the non-staple binding mechanism; and fastening members for coupling and decoupling the staple-binding unit and the non-staple binding unit.

5. A sheet-binding apparatus for binding sheets together, comprising:

a transporting unit for transporting sheets;

an automatic processing section in which sheets are automatically set by the transporting unit;

an ejecting section for ejecting the sheets processed in the automatic processing section;

an accumulating section for accumulating the sheets ejected by the ejecting section;

a first manual processing section arranged at a position different from that of the automatic processing section, wherein sheets are manually set from outside;

a first binding mechanism for binding the sheets set in the automatic processing section and first manual processing section;

a second manual processing section in which sheets are manually set from outside; and a second binding mechanism for binding the sheets set in the second manual processing section.

6. The sheet-binding apparatus according to claim 5, wherein the first and second manual processing sections are arranged in front of the sheet-binding apparatus; and the second manual processing section has a support section for supporting a part of each sheet set in the first manual processing section.

7. The sheet-binding apparatus according to claim 5, wherein the second manual processing section is arranged at a rear side; and the accumulating section has a support surface supporting a part of each sheet set in the second manual processing section.

8. The sheet-binding apparatus according to claim 5, wherein the first binding unit has a staple-binding mechanism for binding the sheets with staples, and the second binding unit has a non-stable binding mechanism for binding the sheets without using staples.

9. The sheet-binding apparatus according to claim 5, wherein the first manual processing section has a first insertion port for setting sheets; the second manual processing section has a second insertion port for setting sheets; and the second insertion port has a width smaller than that of the first insertion port.

10. An image forming system comprising:

a reading apparatus for reading images;

an image forming apparatus for forming, on a sheet, an image read by the reading apparatus; and a sheet processing apparatus for performing a post-processing on the sheet having an image formed by the image forming apparatus, wherein the sheet processing apparatus comprises:

a first insertion section having a slit through which sheets may be inserted from outside;

a first manual binding section for binding the sheets inserted into the first insertion section;

a second insertion section having a slit through which sheets may be inserted from outside; and a second manual binding section for binding the sheets inserted into the second insertion section, and wherein the first manual binding section of the sheet processing apparatus is arranged in a space between the image forming apparatus and the reading apparatus, and the second manual binding section of the sheet processing apparatus is arranged outside the space.

11. The image forming system according to claim 10, further comprising:

a staple-binding mechanism provided at the first manual binding section and configured to perform staple binding on the sheets inserted from the first insertion section; and a non-staple binding unit provided at the second manual binding section and configured to perform non-staple binding on the sheets inserted from the second insertion section.

12. The image forming system according to claim 10, further comprising:

an automatic processing section arranged in the space and configured to bind the sheets set automatically; and an accumulating section arranged outside the space and configured to accumulate the sheets bound in the automatic processing section;

wherein the second manual binding section is arranged adjacent to one end of the accumulating section, as viewed in the widthwise direction of the sheets.

13. The image forming system according to claim 10, wherein the first manual binding section has a first insertion hole and is arranged, positioning the first insertion hole above the second manual binding section.

14. The sheet-binding apparatus according to claim 5, wherein the first manual processing section is arranged near one end of each sheet in the automatic processing section, as viewed in the widthwise direction of the sheet; and the second manual processing section is arranged near one end of each sheet in the accumulating section, as viewed in the widthwise direction of the sheet.

* * * * *